US005339714A

United States Patent [19]

Sinclair, Sr.

[11] Patent Number: 5,339,714

[45] Date of Patent: Aug. 23, 1994

[54] METHOD AND MACHINE FOR PRODUCING PACKAGING MATERIAL

[75] Inventor: Robert F. Sinclair, Sr., Des Peres, Mo.

[73] Assignee: Sinclair Enterprises, Inc., St. Louis, Mo.

[21] Appl. No.: 153,775

[22] Filed: Nov. 17, 1993

Related U.S. Application Data

[63] Continuation of Ser. No. 951,142, Sep. 25, 1992, abandoned.

[51] Int. Cl.[5] ..... B26D 7/10

[52] U.S. Cl. ..... 83/16; 83/24; 83/100; 83/167; 83/171; 83/651.1; 83/857

[58] Field of Search ..... 83/16, 24, 100, 167, 83/171, 404.3, 408, 651.1, 856, 857, 858

[56] References Cited

U.S. PATENT DOCUMENTS

| | | | |
|---|---|---|---|
| 3,080,612 | 3/1963 | Buchmann | 83/171 X |
| 3,088,353 | 5/1963 | Hanington | 83/100 X |
| 3,506,046 | 4/1970 | Webb | 83/167 |
| 3,600,994 | 8/1971 | Zapater | 83/100 |
| 3,830,123 | 8/1974 | Wilgus | 83/171 |
| 4,222,299 | 9/1980 | Treffner et al. | 83/171 X |
| 4,300,421 | 11/1981 | Yano | 83/99 |
| 4,301,702 | 11/1981 | Collier | 83/171 X |

*Primary Examiner*—Eugenia Jones

*Attorney, Agent, or Firm*—Polster, Lieder, Woodruff & Lucchesi

[57] ABSTRACT

The production of packaging material for expanded polystyrene (EPS) includes randomly placing a piece of EPS of any size or shape across a first grid of wires, cutting the EPS into strips by heating the wires, allowing the strips to fall to a second grid of wires, and cutting the EPS strips by heating the second set of wires.

11 Claims, 1 Drawing Sheet

METHOD AND MACHINE FOR PRODUCING PACKAGING MATERIAL

This is a continuation of copending application Ser. No. 07/951,142, filed on Sep. 25, 1992 and now abandoned.

BACKGROUND OF THE INVENTION

This invention relates to packaging material made from expanded polystyrene (EPS) and, in particular, to a method of recycling EPS to produce loose packaging material.

Expanded polystyrene is commonly used to protect products during shipping. The EPS currently used for loose packaging material is generally the "peanuts" which has smooth and rounded edges. EPS peanuts are not very dense, only about one half pound per cubic foot. Because of its shape and low density, these "peanuts" may allow the product to settle during shipping. If the product does settle, it, of course, looses all the protection afforded by the loose peanuts.

Fast food, eggs, electronic products, tools, and many other types of products are packaged in expanded polystyrene (EPS). This EPS is much denser than the "peanuts." It has a density, on the average, of one to one and one half pounds per cubic foot. If this denser EPS were used to produce loose packaging material, it would not allow the shipped product to settle as easily. This would especially be true if the loose packaging did not have rounded edges and would bridge. However, no process is presently known of which will cut large blocks of EPS into chips suitable for use as a loose packaging material efficiently and economically.

SUMMARY OF THE INVENTION

One object of this invention is to provide a method of recycling EPS to produce loose packaging material.

Another object is to provide such a method which will accept EPS of any shape and size.

Another object is to provide a machine which will produce such loose packaging material easily and economically.

These objects will be apparent to those skilled in the art in view of the following disclosure and accompanying drawings.

In accordance with this invention, generally stated, a method is provided for recycling a piece of expanded polystyrene of any size or shape into a chip of a size appropriate for use as loose packing material. The method includes placing a piece of EPS on a first grid of wires, heating the wires of the first grid to a temperature sufficient to cut the EPS into strips, allowing the EPS strips to drop onto a second grid of wires; and heating the wires of the second grid to a temperature sufficient to cut the EPS strips into chips. The wires of the grids are connected to a source of power so that the cutting is accomplished by resistance heating.

The machine used for recycling expanded polystyrene into loose packaging material has a frame, a first platform having a grid of wires and a second platform having a grid of wires. The first and second platforms are vertically spaced from each other and their wires are connected to a low voltage current source. Each grid of wires has two layers of wire which are spaced from each other, each layer having a plurality of generally parallel wires. Each grid defines a plurality of squares. Preferably, the squares of the first grid are larger than the squares of the second grid, the squares of the first grid being approximately 1" on a side, and the squares of the second grid being approximately $\frac{7}{8}$" on a side.

DESCRIPTION OF THE PREFERRED EMBODIMENT

Figure 1:
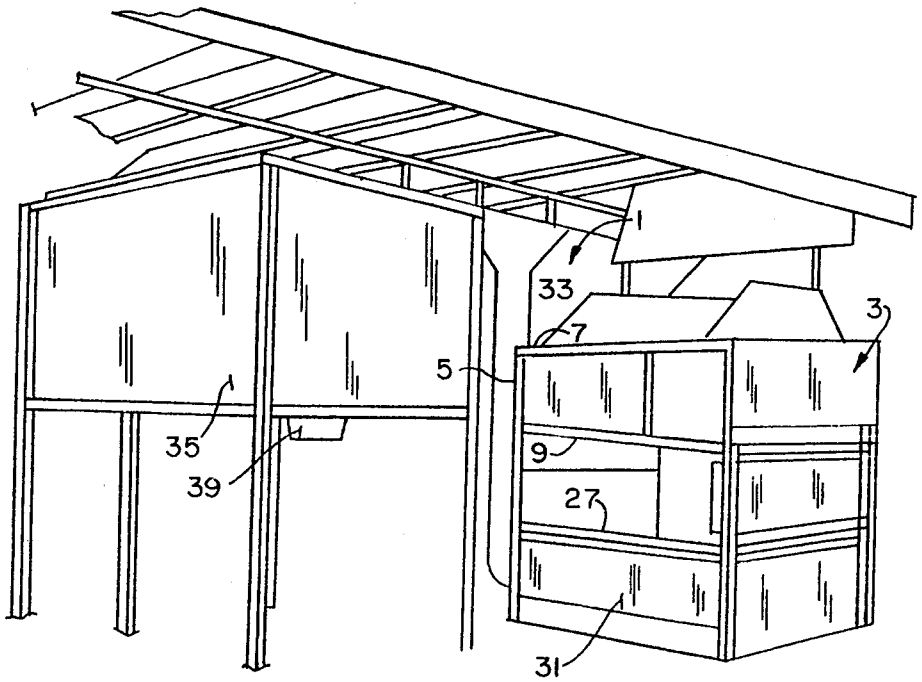
FIG. 1 is a perspective view of a machine used to produce loose packaging material from expanded polystyrene.
Figure 2:
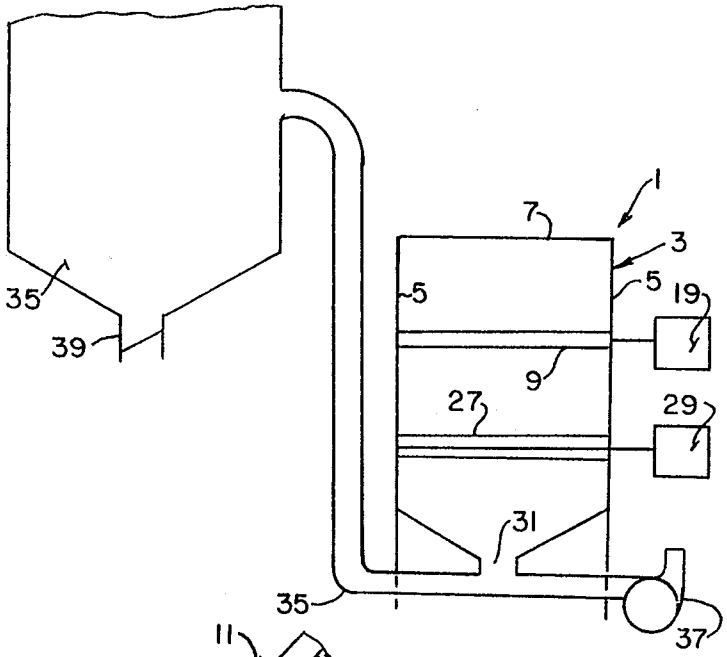
FIG. 2 is a block diagram of the machine of FIG. 1.
Figure 3:
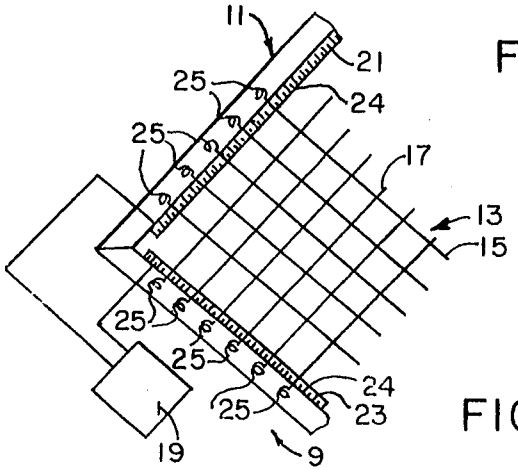
FIG. 3 is an enlarged sectional view of a platform of the machine of FIGS. 1 and 2.

Referring now to the FIG. 1, reference numeral 1 indicates one illustrative embodiment of a machine used for recycling blocks of expanded polystyrene into pieces of polystyrene that may be used as loose packaging material. Machine 1 includes a frame 3 having four vertical supports 5 and cross-members 7 at their tops to join the vertical supports 5. A first platform 9 is positioned below cross-members 7. Platform 9 includes a frame 11 which carries a wire grid 13. Grid 13 has a first layer 15 of generally parallel wires and a second layer 17 of generally parallel wires. Wires 17 are at an angle to wires 15. Preferably, wires 15 and 17 are perpendicular to one another.

Wires 15 and 17 are heating elements and are preferably made from nickel-chromium. The wires are connected to a source 19 of electricity. Electrical source 19 is preferably a low voltage (24 V) DC power supply which will heat wires 15 and 17 to a temperature sufficient to melt or vaporize the expanded polystyrene. Frame 11 is made of non-conductive material having a sloped surface. Rods 21 and 23 are secured to frame 11 and are connected to power source 19. Rods 21 and 23 are preferably silicon-bronze threaded rods, having sixteen threads 24 to an inch. Wires 15 and 17 are laid across rods 21 and 23, respectively, to pass the current to the wires. The wires preferably rest in the threads, so that they can be accurately spaced. The wires are held in contact with their respective rods by springs 25, which are hooked at one end to frame 11. Because the surface of frame 11 is sloped, the outer edge of the frame is narrower than the inner edge, allowing a hook formed at the end of spring 25 to hold spring 25 to the frame. A spring 25 is attached to both ends of each wire. Springs 25 serve to anchor the wires to the frame 11 by way of the spring's tension. Wires 15 and 17 are vertically spaced apart by approximately $1\frac{1}{4}$" so that they do not short out. Wires 15, as well as wires 17, are horizontally spaced apart by about 1", to form a one square inch grid. Of course other size grids could be used. The rods used allow for the wires to be moved horizontally in increments of 1/16".

A second platform 27 is positioned below first platform 9. Platform 27 is substantially identical to platform 9 and carries a second grid of wires. The grid of platform 27, however, is preferably smaller that that of platform 9. The grid of platform 27 preferably forms squares which are $\frac{7}{8}$" on a side. The wires of platform 27 are also heating elements and are electrically connected to a second power source 29. It will be understood, of course, that the two wire grids could be connected to the same power source. Power source 29 is also a low voltage (24 V) DC power source. Platform 29, for reasons explained below, is positioned at least 12" below platform 9. Preferably, platform 27 is approximately 19" below platform 9.

A venturi throat 31 is located beneath second platform 29. Venturi throat 31 is connected to piping 33 which leads to a storage bin 35. A venturi effect is created by a blower 37 which forces air past throat 31. The venturi pulls cut EPS chips from throat 31 and carries them to storage bin 35. A funnel 39, on the bottom of storage bin 35, allows the EPS chips to be bagged for sale. Funnel 39 has a valve to control to flow of the chips into the bags.

To recycle EPS into pieces which may be used as loose packaging material, a piece of EPS of any shape or size, is placed on first platform 9. The wires 15 and 17 of grid 13 are heated to a temperature sufficient to melt or vaporize the EPS and the EPS source essentially falls through platform 9 to form strips of EPS. These EPS strips then fall onto second platform 27 where they are cut into smaller pieces. Because the platforms are spaced apart, the EPS strips tumble to second platform 19. Thus if a long strip is produced by grid 13, it will fall so that its long side is in contact with wires 19. Heated wires 19 will then cut the EPS strip a second time, to produce smaller chips of EPS which are suitable for use as loose packaging. The heat from wires 19 produces a convective stream of rising air. This convection further enhances the tumbling of the EPS pieces which are cut by wires 13 to further ensure that the EPS strip will fall on to platform 17 to be cut at a different angle.

Grid 13 forms EPS strips that are irregular in shape. This irregularly shaped EPS chip does not nest. It also helps prevent the settling of the product during shipment. The shipped product is thus better protected. However, if a thick piece of EPS is used as a source, the strips formed by grid 13 may be too long to be used for packing. Thus, the second platform is used to cut the EPS strips into chips which are of a more appropriate size for packing material. Thus, one grid could be used to form the EPS chips, however, one grid cannot be used for a very wide range of sizes of EPS pieces. If large pieces of EPS are to be used to form packaging material, two grids are needed. Obviously, more grids could be used, if desired.

The chips of EPS cut by the grid of platform 27 fall into throat 31. The venturi effect created by the air being forced past throat 31 pulls the EPS chips from throat 31 into piping 33 and carries them to storage bin 35. The use of a venturi to move the EPS chips is preferable to the use of an impeller induced vacuum. If an impeller were used to pull the chips to storage bin 35, it would further break up the EPS chips and may produce undesirable dust.

It will be seen that this machine allows for a simple and quick method, that uses no mechanical energy, to cut large blocks of EPS to a size suitable for use as loose packing. Numerous variations, within the scope of the appended claims, will be apparent to those skilled in the art in light of the foregoing description and accompanying drawings. For example, the size and spacing of the grids can be altered, as can the number of grids used. These variations are merely illustrative.

Having thus described the invention, what is claimed and desired to be secured by Letters Patent is:

1. A method of producing loose irregularly shaped chips of packaging material from expanded polystyrene consisting of:

placing a piece of expanded polystyrene on a first stationary grid of wires;

heating the wires of the first stationary grid of wires to a temperature sufficient to melt the expanded polystyrene to cut the expanded polystyrene into strips;

dropping the expanded polystyrene strips onto a second stationary grid of wires;

heating the wires of the second stationary grid of wires to create an upward draft to enhance tumbling of the falling expanded polystyrene strips;;

further heating the wires of the second stationary grid of wires to a temperature sufficient to melt the expanded polystyrene strips to cut the expanded polystyrene strips into irregularly shaped chips of expanded polystyrene; and collecting said irregularly shaped chips of expanded polystyrene.

2. The method of claim 1 wherein said heating steps include heating said wire by resistance heating.

3. The method of claim 1 wherein said collecting step includes dropping said irregularly shaped chips of expanded polystyrene into the throat of a venturi blower; and transporting said irregularly shaped chips of expanded polystyrene to a storage bin by vacuum.

4. A machine for recycling expanded polystyrene into loose packaging material, the machine consisting of a frame, a first stationary platform having a stationary grid of wires and a second stationary platform having a stationary grid of wires, each said grid of wires including an upper set of spaced, generally parallel wires and a lower set of spaced, generally parallel wires, said lower set of wires being generally transverse to the upper set of wires to define a plurality of squares; said first and second platforms being vertically aligned and spaced from each other; said wires of said first and second platforms being connected to a source of current.

5. The machine of claim 4 wherein said source of current is low voltage current.

6. The machine of claim 4 wherein said first and second platforms are spaced apart by at least one foot.

7. The machine of claim 4 wherein said upper and lower sets of wires of each said grid are vertically spaced from each other.

8. The machine of claim 4 wherein the squares of said first grid are larger than the squares of said second grid.

9. The machine of claim 8 wherein the squares of said first grid are approximately 1" on a side, and the squares of said second grid are approximately $\frac{7}{8}$" on a side.

10. A machine for recycling expanded polystyrene into loose packaging material, the machine comprising:

a frame;

a first stationary platform on said frame, said first stationary platform having an upper set of generally parallel wires and a lower set of generally parallel wires, said lower set of generally parallel wires being generally transverse to said upper set of generally parallel wires to define a first stationary grid;

a second stationary platform on said frame spaced below and vertically aligned with said first stationary platform, said second stationary platform having an upper set of generally parallel wires and a lower set of generally parallel wires, said lower set of generally parallel wires being generally transverse to said upper set of generally parallel wires to define a second stationary grid, the squares of said first grid being larger than the squares of said second grid;

said wires of said first and second platform being connected to a source of current; and means for changing the spacing between the wires of each grid to change the size of the squares.

11. The machine of claim 10 wherein each said grid includes rods having spaced threads, said wires being set in said threads; said means for changing the spacing of said wires including said threads, wherein said wires can be moved from the thread in which said wires sit to another desired thread.

* * * * *